US008973564B1

(12) United States Patent
Saber et al.

(10) Patent No.: US 8,973,564 B1
(45) Date of Patent: Mar. 10, 2015

(54) RECREATIONAL THROWING APPARATUS AND CORRESPONDING OBJECTS THEREFOR

(75) Inventors: Michael Saber, Denver, CO (US); Joseph Buescher, Littleton, CO (US)

(73) Assignee: Chilkoot Trail Ventures, LLC, Littleton, CO (US)

( * ) Notice: Subject to any disclaimer, the term of this patent is extended or adjusted under 35 U.S.C. 154(b) by 0 days.

(21) Appl. No.: 12/860,703

(22) Filed: Aug. 20, 2010

(51) Int. Cl.
*A63B 65/00* (2006.01)

(52) U.S. Cl.
USPC ..... 124/5

(58) Field of Classification Search
USPC ..... 124/5, 4, 42, 44; 473/505, 589, 590, 473/507, 512, 558, 591, 592, 615
See application file for complete search history.

(56) References Cited

U.S. PATENT DOCUMENTS

| | | | | | |
|---|---|---|---|---|---|
| 530,116 | A | | 12/1894 | Murphy | |
| 2,493,245 | A | * | 1/1950 | Hansen | 124/5 |
| 3,049,352 | A | * | 8/1962 | Hancock | 473/514 |
| D197,655 | S | | 3/1964 | Kuhn | D34/15 |
| 3,428,036 | A | | 2/1969 | Parker | |
| 3,589,349 | A | | 6/1971 | Parker | |
| 3,841,292 | A | | 10/1974 | Hoffman | |
| 3,898,765 | A | * | 8/1975 | Lee | 446/63 |
| D244,628 | S | | 6/1977 | Wright | |
| 4,030,472 | A | * | 6/1977 | Watkins | 124/5 |
| D249,815 | S | | 10/1978 | Huelskamp | D21/722 |
| 4,222,562 | A | * | 9/1980 | Gardner | 273/129 K |
| 4,302,900 | A | | 12/1981 | Rayner | |
| 4,364,371 | A | | 12/1982 | Woolard | |
| 4,549,521 | A | * | 10/1985 | Hargrave, Jr. | 124/5 |
| 4,850,927 | A | | 7/1989 | Caranica | |
| 5,033,743 | A | | 7/1991 | Wright | |
| 5,129,650 | A | | 7/1992 | Hayman | |
| 5,207,420 | A | | 5/1993 | Crawford et al. | |
| D348,915 | S | | 7/1994 | Fraser | |
| 5,399,136 | A | | 3/1995 | Bart | 428/110 |
| D363,752 | S | | 10/1995 | Shumber et al. | D21/236 |
| D367,504 | S | | 2/1996 | Barzani | |
| D400,620 | S | | 11/1998 | Barton, Jr. | D21/713 |
| D408,482 | S | | 4/1999 | Morrison | |
| D411,269 | S | | 6/1999 | Albarelli, Jr. | |
| 6,003,470 | A | | 12/1999 | Budman | |
| D418,880 | S | | 1/2000 | Albarelli, Jr. | |
| D421,078 | S | | 2/2000 | Weiss, Jr. | |
| 6,024,054 | A | | 2/2000 | Matt et al. | 119/796 |
| 6,048,283 | A | | 4/2000 | Albarelli, Jr. | |
| D424,640 | S | | 5/2000 | Oblack | |
| 6,076,829 | A | | 6/2000 | Oblack | |
| 6,220,980 | B1 | | 4/2001 | Adler | |
| D468,378 | S | | 1/2003 | Routzong | |
| 6,651,590 | B2 | | 11/2003 | Willinger et al. | |
| 6,736,765 | B2 | | 5/2004 | Wallace et al. | 482/106 |
| D498,799 | S | | 11/2004 | Kerry | D21/662 |

(Continued)

*Primary Examiner* — Gene Kim
*Assistant Examiner* — Amir Klayman
(74) *Attorney, Agent, or Firm* — Hayes Soloway P.C.

(57) ABSTRACT

A recreational throwing apparatus comprises, in the exemplary embodiment, a handle portion and an engagement portion engaged with the handle portion and configured for selective frictional engagement with an engagement aperture of an object. Additionally, the engagement portion provides a means for substantially preventing rotation of the object about the engagement portion when engaged therewith. Thus, with the object frictionally engaged with the engagement portion in a desired orientation, the apparatus may be swung in a desired direction, causing the object to disengage and travel in the desired direction.

20 Claims, 6 Drawing Sheets

(56) References Cited

U.S. PATENT DOCUMENTS

| | | | | |
|---|---|---|---|---|
| D505,233 | S | 5/2005 | Viola | D30/160 |
| 6,896,578 | B2 | 5/2005 | Shaw | 446/490 |
| D511,029 | S | 10/2005 | Williinger | D30/160 |
| 7,032,583 | B1 | 4/2006 | Hall | |
| D545,509 | S | 6/2007 | Wang | D30/160 |
| D549,889 | S | 8/2007 | Winkler et al. | |
| D553,809 | S | 10/2007 | Gick | |
| D554,717 | S | 11/2007 | McKinnell et al. | D21/722 |
| 7,326,122 | B2 | 2/2008 | Park | 473/256 |
| D599,963 | S | 9/2009 | Crane et al. | |
| 7,686,001 | B2 * | 3/2010 | Fitt | 124/5 |
| D623,247 | S | 9/2010 | Zawitz | D21/707 |
| D624,251 | S | 9/2010 | Rutherford | D30/160 |
| D637,248 | S | 5/2011 | Levin et al. | D21/722 |
| D640,018 | S | 6/2011 | Rutherford | D30/160 |
| 8,104,145 | B1 | 1/2012 | Hajianpour | 16/428 |
| D658,243 | S | 4/2012 | Saber et al. | |
| D660,384 | S | 5/2012 | Saber et al. | |
| 8,312,844 | B2 | 11/2012 | Mann | |
| D695,358 | S | 12/2013 | Saber et al. | |
| 2004/0029656 | A1 | 2/2004 | Vannoy | |
| 2006/0162675 | A1 | 7/2006 | Ghalebi et al. | 119/796 |
| 2007/0207871 | A1 | 9/2007 | Traub | |
| 2010/0024741 | A1 | 2/2010 | Schoppman | 119/795 |
| 2011/0185980 | A1 | 8/2011 | Chefetz et al. | 119/709 |
| 2013/0074780 | A1 | 3/2013 | Wechsler | |

* cited by examiner 30B
31E
30B
31D
35
20
32
31
33
40
30
30B
36
34
44F
44A
48
44C
30A
33
37
41
44D
44B
44E
39

20A
32A
31A
33A
30A

33AA
37A
41A
45A
45B
35A
34A
46B
36A
46A
39A
49A
48B
34B
46D
36B
46E
46
46C
49B
20B
31B
32B
30B

RECREATIONAL THROWING APPARATUS AND CORRESPONDING OBJECTS THEREFOR

BACKGROUND OF THE INVENTION

1. Field of the Invention

Aspects of this invention relate generally to toys, and more particularly to an apparatus configured for allowing a user to throw various types of objects without having to directly handle the objects.

2. Description of Related Art

Many people engage in a wide range of various recreational activities that involve the throwing of objects, such as a ball or disc. Depending on the type of object involved, the activity, and the respective abilities of the participants, such an object may be thrown for relatively long periods of time. Additionally, if the object is dropped, a participant must typically bend over to pick it back up. Over time, these repetitive motions can begin to strain the participants' muscles. Furthermore, depending on a given participant's strength and skill, that participant may not be able to throw the object as far or as frequently as desired.

While many object throwing activities are carried out by two or more people, often times they may involve animals as well, such as a dog. Handling an object in such a situation gives rise to additional concerns, on top of those discussed above. First, directly handling an object that has been in the mouth of an animal can be unsanitary and unpleasant, as the animal would likely leave saliva on the object. Secondly, depending on the temperament of the animal, the participants may also run the risk of being bitten when handling the object.

The following art defines the present state of this field:

U.S. Pat. Nos. 3,428,036 and 3,589,349 to Parker are generally directed to an improved ball-gripping and throwing apparatus. The ball-holding member is non-adjustably and immovably fixed to the spring handle by an integral extension of the ball-gripping arm elements. The ball-holding member otherwise includes a pair of spaced flexible gripping leaves and a pair of pressure arms adjustably forced against the outside of the gripping leaves to vary the pressure with which they engage and hold a ball positioned therebetween.

U.S. Pat. No. 3,841,292 to Hoffman is generally directed to a catapult toy. A flexible resilient wand with a finger grip handle has a tapered whippable shank and a shaped front end to receive a mass to be loosely, but frictionally, fitted on said front end. The toy is catapulted from said wand by a whipping action by the operator.

U.S. Pat. No. 4,364,371 to Woolard is generally directed to a ball throwing implement which includes a flexible shaft having at one end a threaded portion on which a stop disk is movably mounted. A ball or similar game element having a diametrical bore is slipped over the end of the flexible shaft into position against the stop disk. On the other side of the ball from the stop disk, a resilient release element is incorporated in the shaft so that it bears against the wall of the diametrical bore. By moving the stop disk to adjust the extent of engagement of the diametrical bore with the release element, the force required to throw the ball from the shaft may be adjusted.

U.S. Pat. No. 5,129,650 to Hayman is generally directed to a set of flexible throwing rods. Each rod has a handle on one end for grasping and a gradual narrowing taper toward the other end. Each throwing rod has a varying length ranging from approximately 15 inches to approximately four feet. A rod is selected based upon the distance to a target. The rod slides through a diametrical hole in a ball. A whip-like action of the rod forces the ball off of the end.

U.S. Pat. Nos. D424, 640 and 6,076,829 to Oblack are generally directed to a ball throwing apparatus that includes an elongated shaft with a half-spherical structure attached to or formed at its distal end. The distal end is designed to easily engage and pick up a ball for throwing without the user having to touch the ball.

U.S. Patent Application Publication No. US 2004/0029656 to Vannoy is generally directed to a ball launcher that allows a user to retrieve a ball from the ground and launch the ball, with accuracy, farther than the user can throw the ball by hand. The ball launcher uses an elongated tubular member having a handle at one end and an open opposing end. An annular ring encompasses either the inner surface of the tubular member proximate the open end, or the periphery of the open end. The annular ring has a diameter that is slightly smaller than the diameter of the ball to be retrieved and when the ball launcher is pressed upon the ball, the ball slightly deforms or the annular ring slightly expands allowing the ball to pass the annular ring and into the tubular member. The tubular member is arcuately swung in order to launch the ball therefrom.

U.S. Pat. No. 7,032,583 to Hall is generally directed to a device for throwing a ball. The pouch is disposed on the end of an arm so that the ball contained in the pouch can be thrown in an overhand or underhand manner by the user. The pouch is attached to the arm on one end and a rubber band-like member is disposed in the pouch on the other open end, which rubber band holds the ball inside the pouch. As the arm and pouch are thrown by a user, the ball gains enough inertia through the arc of the throwing motion that the ball stretches the rubber band and passes between the rubber band and the pouch and, therefore, exits from the open end of the pouch.

The prior art described above teaches devices configured for allowing a user to pick up and throw a ball without having to directly handle the ball. Additionally, these prior art devices allow the user to throw the ball with relatively greater ease. However, many of these prior art devices are incapable of (1) ensuring that the object is engaged with the device in a desired orientation, and (2) allowing the user to more accurately direct the flight path of the object when thrown, by virtue of those prior art devices and corresponding objects having substantially cylindrical engagement means.

SUMMARY OF THE INVENTION

Aspects of the present invention teach certain benefits in construction and use which give rise to the advantages described below.

A recreational throwing apparatus is disclosed which is configured for allowing a user to throw various types of objects without having to directly handle the objects, as herein described.

The apparatus comprises, in an exemplary embodiment, a handle portion and an engagement portion engaged with the handle portion and configured for selective frictional engagement with an engagement aperture of an object. Additionally, the engagement portion provides a means for substantially preventing rotation of the object about the engagement portion when engaged therewith. In use, a user grasps the handle portion of the throwing means then inserts the substantially wedge-shaped engagement portion of the throwing means into the engagement aperture of the object. Again, the engagement aperture is configured for preventing the object from rotating about the engagement portion when engaged therewith, allowing the object to be thrown in a desired orientation.

With the object oriented in the desired orientation, the user then swings the throwing means in a desired direction, causing the object to disengage and travel in the desired direction.

A primary objective inherent in the above described apparatus and method of use is to provide advantages not taught by the prior art.

Another objective is to provide such an apparatus that allows the user to throw various types of objects without having to directly handle the objects.

A further objective is to provide such an apparatus that substantially prevents the object from rotating on the throwing means when engaged therewith, allowing the object to be thrown in a desired orientation.

A still further objective is to provide such an apparatus that allows the user to more accurately direct the flight path of the object when thrown.

Other features and advantages of aspects of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate aspects of the present invention. In such drawings.

DETAILED DESCRIPTION OF THE INVENTION

Figures 1, 2, 3:
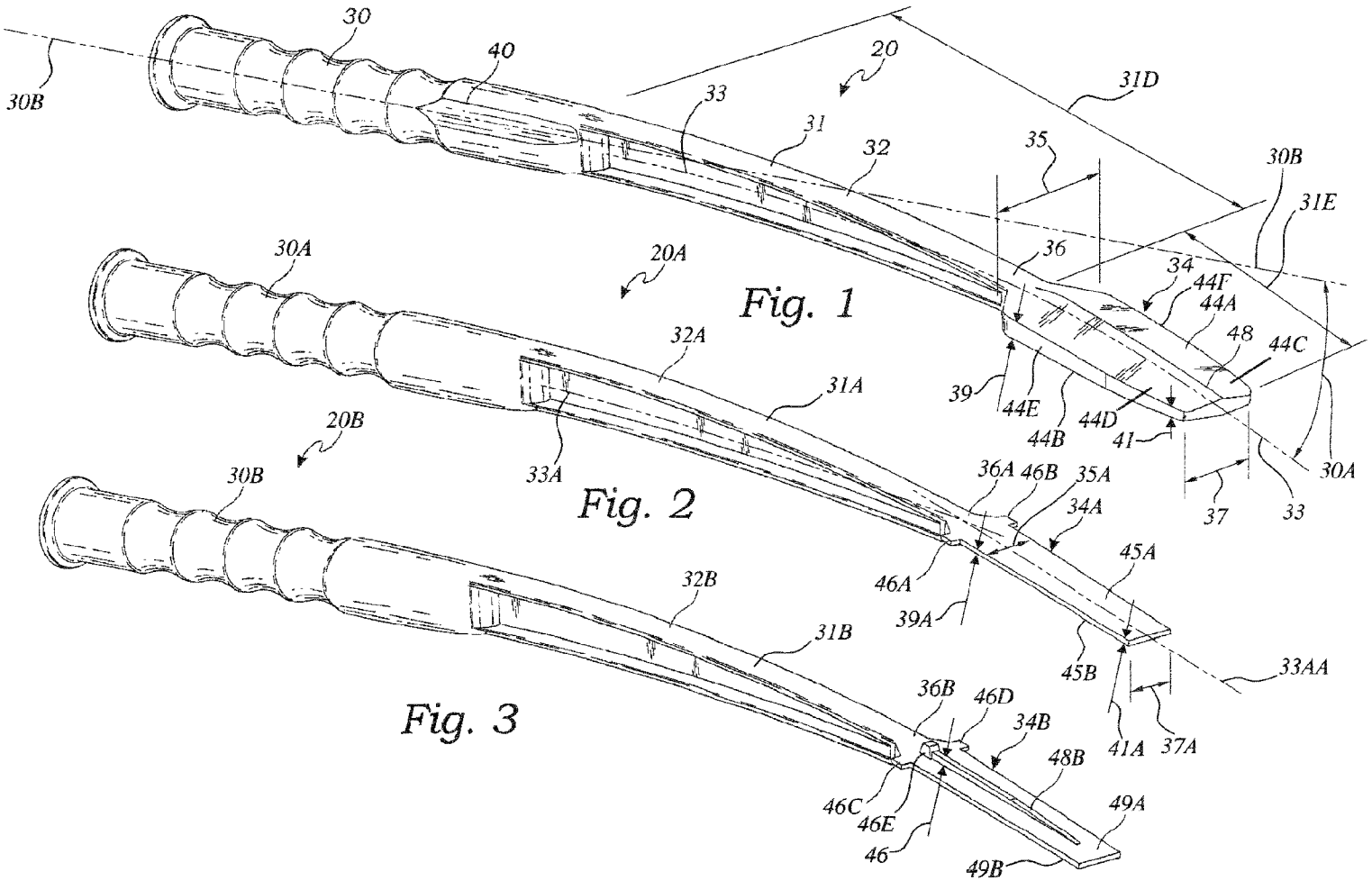
FIG. 1 is a perspective view of one embodiment of a throwing apparatus disclosed in this application.
FIG. 2 is a perspective view of a further embodiment of a throwing apparatus disclosed in this application.
FIG. 3 is a perspective view of a still further embodiment of a throwing apparatus disclosed in this application.

Turning now to FIG. 1, there is shown a perspective view of an exemplary embodiment of a recreational throwing apparatus 20. The throwing apparatus 20 is configured for selectively engaging and throwing an object, as discussed in greater detail below. At the outset, it should be noted that the term "object" is herein used to describe any type of object that may be used in conjunction with the throwing apparatus 20. For illustrative purposes, certain objects—namely, a ball 24 (FIG. 5), a flying disc 26 (FIG. 8), and a football shaped object 28 (FIG. 9)—are specifically mentioned. However, the present invention should not be read as being so limited to only those types of objects.

Referring again to FIG. 1, the throwing apparatus preferably comprises a handle portion 30, a shank 32 engaged proximally with the handle portion 30, and an engagement portion 34 engaged with a distal end 36 of the shank 32. In the exemplary embodiment, the throwing apparatus 20 is molded as a unitary piece. However, in alternate embodiments, each of the handle portion 30, shank 32 and engagement portion 34 may be separate components engaged with one another. Furthermore, while the exemplary embodiment is preferably made of plastic, the present invention may be made of any other type of material or combination of materials, now known or later developed, that enables the present invention to carry out substantially the same functionality herein described.

With continued reference to FIG. 1, the handle portion 30 is configured for allowing a user 38 (see a user in FIGS. 10 and 11) to grip the handle portion 30 tightly enough in a desired orientation such that the throwing apparatus 20 does not unintentionally fly out of the user's hand 39 during use. Additionally, in the exemplary embodiment, the handle portion provides an at least one substantially longitudinally oriented finger guide 40 ergonomically positioned and configured for allowing an index finger 41 of the user's hand 39 to extend and rest thereon, thereby providing further balance and stability when throwing certain types of objects using the device, as discussed further below.

In the exemplary embodiment, the relatively elongated shank 32 has a length 31D and is positioned between and interconnects the handle portion 30 and engagement portion 34. Preferably, the shank 32 is slightly curved 31. The curve 31 is seen by the angle 30A between the axis 30B of the handle 30 and the axis 33 of the shank 32. The curve 31 assists in the throwing of the object, as discussed further below; though, in alternate embodiments, the shank 32 may be substantially linear. In still further embodiments, the throwing apparatus 20 may simply comprise the handle portion 30 and the engagement portion 34, omitting the shank 32 altogether. In the exemplary embodiment, the shank 32 is relatively rigid; however, in alternate embodiments, the shank 32 may be relatively resilient and flexible for creating a whipping action when the throwing apparatus 20 is swung, as discussed further below, allowing the object to be thrown over relatively greater distances.

With continued reference to the exemplary embodiment shown in FIG. 1, the engagement portion 34 has a length 31E and is sized and configured for selective frictional engagement with at least one engagement aperture of an object such as the engagement apertures 42, 42A and 42B (FIGS. 5, 8 and 9) of the respective objects 24, 26 and 28. More specifically, in the exemplary embodiment, the engagement portion 34 is substantially wedge-shaped, providing a pair of opposing, substantially planar engagement surfaces 44A and 44B with opposite outside edges 44E and 44 F. It may also be noted that the surface 44A has a first half 44C and a second half 44D positioned at an angle sloping away from ridge 48 which is centrally disposed along the curved shank axis 33 from proximal width 35 to distal width 37. The engagement portion is tapered in width from the proximal width 35 which is larger than the distal width 37. The engagement portion 34 is also tapered in thickness from the proximal thickness 39 to the distal thickness 41. That is, the proximal thickness 39 is larger than the distal thickness 41. The taper in thickness and the taper in width limit the distance by which the engagement portion 34 may be inserted through the engagement aperture such as the engagement aperture 42 of the object of FIG. 5. Additionally, the tapering assists in reducing the amount of force necessary to disengage the object from the engagement portion 34 during use, thus allowing the object to fly farther with less effort by the user 38. In an alternate embodiment, shown in FIG. 2, the throwing apparatus 20A has a handle 30A connected to a shank 32A that is curved 31A. The shank 32A is in turn connected at its distal end 36A to the engagement portion 34A which is flat and lies along a straight axis 33A. The engagement portion 34A is not tapered but rather relatively flat. The proximal width 35A is essentially the same as the distal width 37A; and the proximal thickness 39A is essentially the same as the distal thickness 41A. Further, the engagement surfaces 45A and 45B are substantially co-planar. Thus even less force is required to disengage the object from the engagement portion 34A during use. Additionally, as shown in this alternate embodiment, the engagement portion 34A may provide an at least one stopper with shoulders 46A and 46B positioned and configured for limiting the distance by which the engagement portion 34A may be inserted through an engagement aperture such as engagement aperture 42 seen in FIG. 5.

Referring back to FIG. 1, the longitudinal ridge 48 is disposed along one or both of the engagement surfaces 44A and 44B. The longitudinal ridge 48 is configured for creating a relatively tighter engagement between the engagement portion 34 and engagement aperture such as engagement aperture 42, in order to reduce the likelihood of the object unintentionally or prematurely disengaging from the engagement portion 34 during use. In the exemplary embodiment, shown in FIG. 1, the height of each ridge such as 48 is relatively minimal. However, in alternate embodiments, such as that shown in FIG. 3, each ridge 48B may be more pronounced. In FIG. 3, the throwing apparatus 20B has a handle portion 30B connected to shank 32B which is curved 31B. As seen the engagement portion 34B is formed to extend from the distal end 36B of the shank 32B. The engagement portion 34B is also shown having shoulders 46C and 46 D. The ridge 48B is shown having a knuckle 46E at the proximal end. The ridge 48 B has a proximal height 46 which tapers to a distal height which is shown to be nominal to provide for a smooth transition to surface 49A. It should also be noted that, in still further embodiments, each engagement surface such as engagement surface 44A may provide a plurality of ridges like ridge 48 and ridge 48B. In a still further embodiment, the engagement portion like engagement portion 34A may be coated with a relatively high-friction material, now known or later developed, such as silicone or the like.

Figures 4, 5:
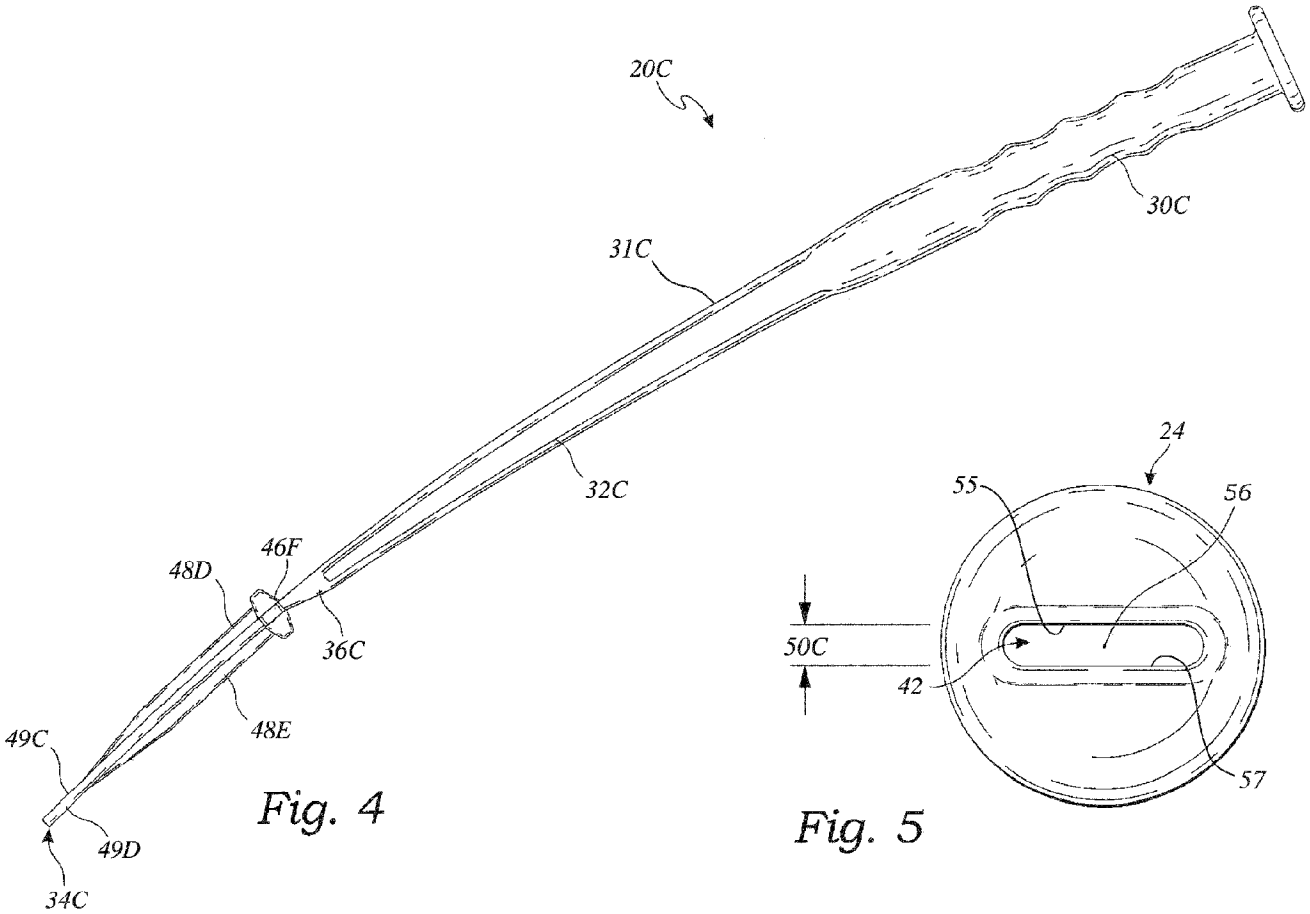
FIG. 4 is a side view of a throwing apparatus similar to that of FIG. 3.
FIG. 5 is an elevational view of an exemplary embodiment of an object to be selectively engaged with and thrown by the throwing apparatus disclosed in this application.

Referring to FIG. 4, a throwing apparatus 20C is shown in a side view with a handle portion 30C connected to a shank 32C that is curved or arcuate 31C. The engagement portion 34C has opposite surfaces 49C and 49 D with ridges 48D and 48E. An octagonal shaped collar 46F is shown on the proximal end of the engagement portion 34C attached to the distal end 36C of the shank 32C.

Figure 6:
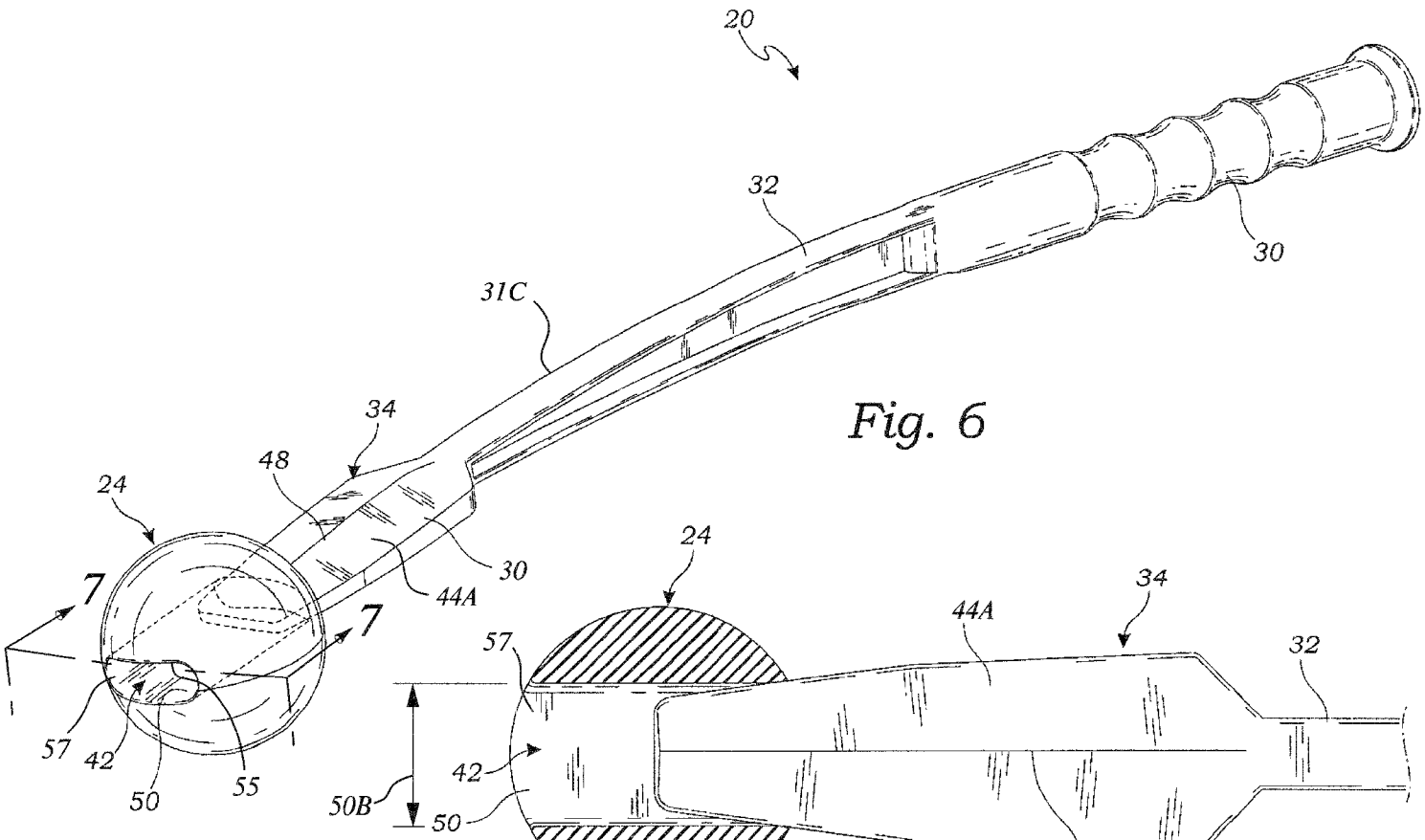
FIG. 6 is a perspective view of the exemplary throwing apparatus of FIG. 1 disclosed in this application selectively engaged with the exemplary object of FIG. 5.
Figure 7:
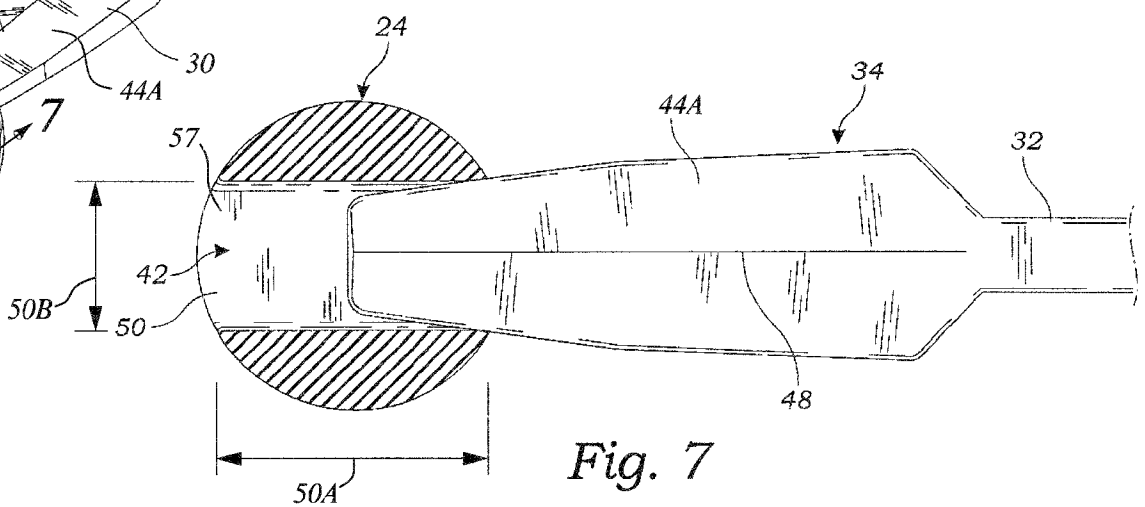
FIG. 7 is a partial cross-sectional view taken along line 7-7 of FIG. 6.

As best shown in FIGS. 1, 6 and 7, the engagement portion 34 functions to prevent rotation of the object, like object 24, about the shank axis 33 extending through the engagement portion 34 when the object is engaged therewith. In other words, the engagement portion 34 and engagement aperture 42 are preferably configured as complementary shapes, such that the object is prevented from rotating about the engagement portion 34 by virtue of the complementary surfaces 44A and 44B of the engagement portion 34 and surfaces 55 and 57 of the engagement aperture 42 (FIG. 5) coming into contact with one another. In the exemplary embodiment, as shown in FIG. 1, the means for substantially preventing rotation comprises the substantially planar engagement surfaces 44A and 44B of the engagement portion 34. As seen in FIGS. 5 and 6, the aperture 42 is somewhat elliptically shaped with the surfaces 55 and 57 forming opposite portions of the inner surface 50. The receiving structure such as aperture 42 has a length 50A, a width 50B and a height or thickness 50 C (FIGS. 5 and 7) selected to snuggly receive the engagement portion 34. It should be noted that, in alternate embodiments, the engagement portion like engagement portions 34, 34A, 34B and 34C and engagement aperture like engagement aperture 42 (FIGS. 5, 6 and 7) may be of any other combination of complimentary shapes and/or configurations, so long as the object is substantially prevented from rotating about its engagement portion when engaged therewith.

Figure 8:
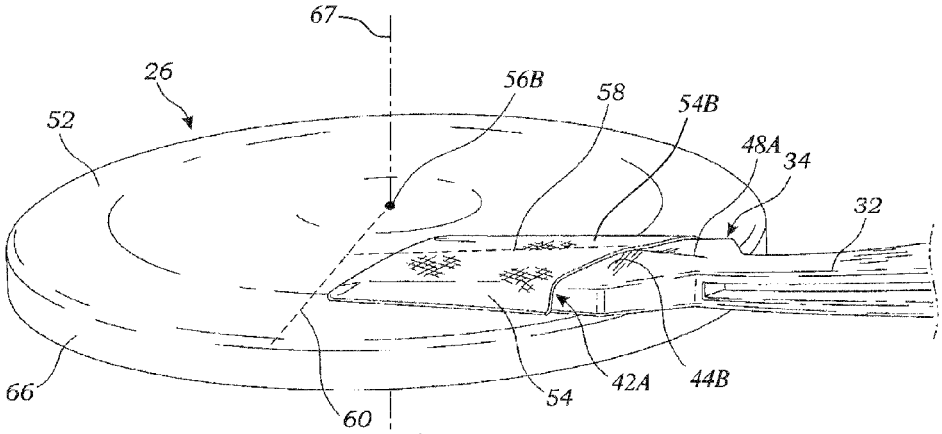
FIG. 8 is a partial perspective view of the exemplary throwing apparatus disclosed in this application selectively engaged with a flying disc.
Figure 9:
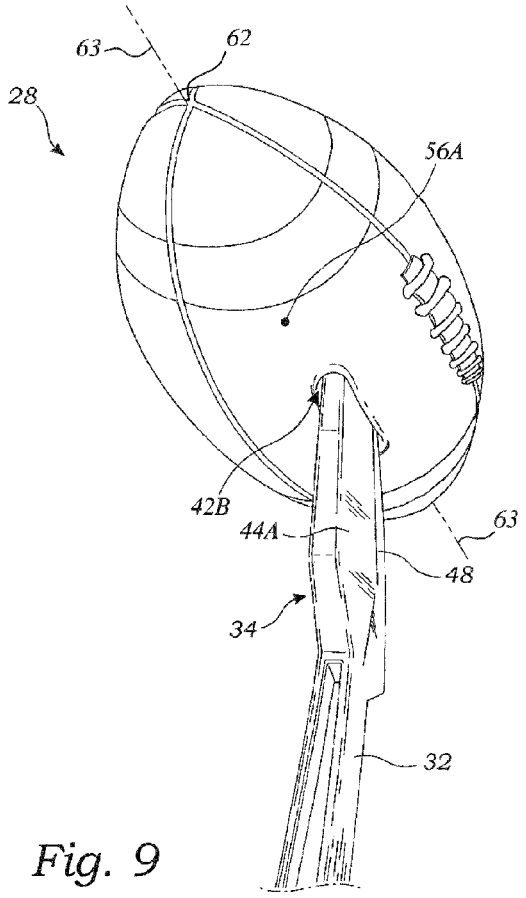
FIG. 9 is a partial perspective view of the exemplary throwing means selectively engaged with an object shaped like a football.

With the throwing means 20 providing the above described features, the object to be thrown may take on the form of virtually anything, so long as it provides at least one appropriately configured engagement aperture like engagement aperture 42. Thus, again, while the exemplary objects described herein are the ball 24, flying disc 26, and football shaped object 28, any other type of object, now known or later developed, may be substituted so long as that object provides the appropriately configured engagement aperture like engagement aperture 42. Furthermore, depending on the dimensions of the object, the engagement aperture 42 may be positioned within the object, as with the ball 24 and football 28, or it may be positioned on an outer surface 52 of the object in the form of a pocket 54, as best illustrated in connection with the flying disc 26. Additionally, again, depending on the dimensions of the object, the engagement aperture, such as engagement aperture 42, may be positioned appropriately so as to mimic the way the user 38 would traditionally grasp the object by hand. For example, the engagement aperture, such as engagement aperture 42, may be positioned proximal a center of mass of the object, such as the center of mass 56 of the ball 24 (FIG. 5). The center of mass 56A may also be slightly offset from the engagement member 34, such as with the football shaped object 28 (FIG. 9). Alternatively, where the object is relatively planar, such as with the flying disc 26 (FIG. 8), the engagement aperture 42A formed by pocket 54, may be positioned at a tangent to the center of 56B. As can be seen in FIG. 8, the pocket 54 has an upper member 54 B, a central axis 58 offset from a radius 60 of the flying disc 26. The surface 44B has a ridge 48A which engages the upper member 54B of the pocket 54.

Figure 10:
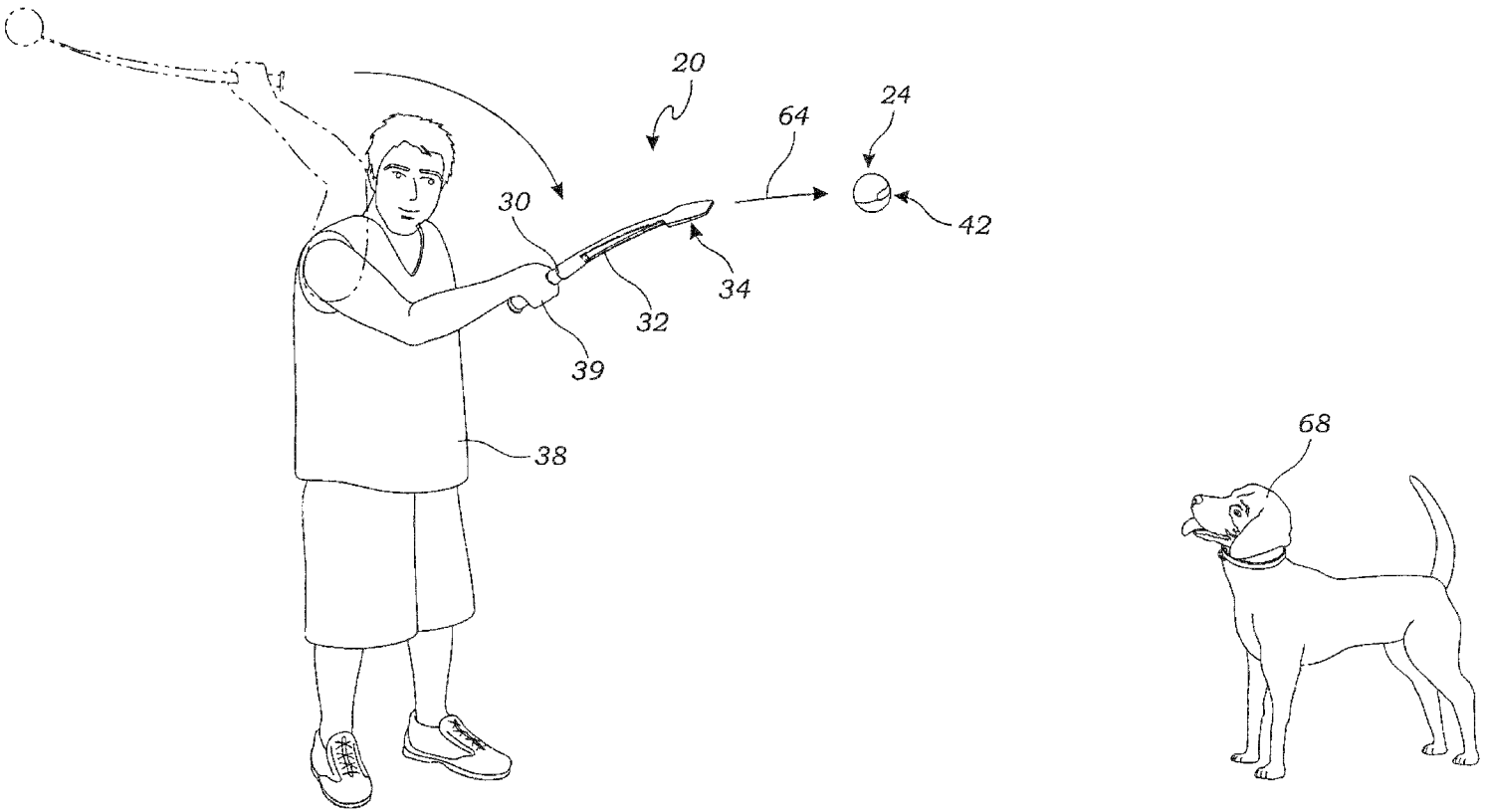
FIG. 10 is a perspective view of a user throwing the exemplary object of FIG. 5 using the exemplary throwing apparatus of FIG. 1.
Figure 11:
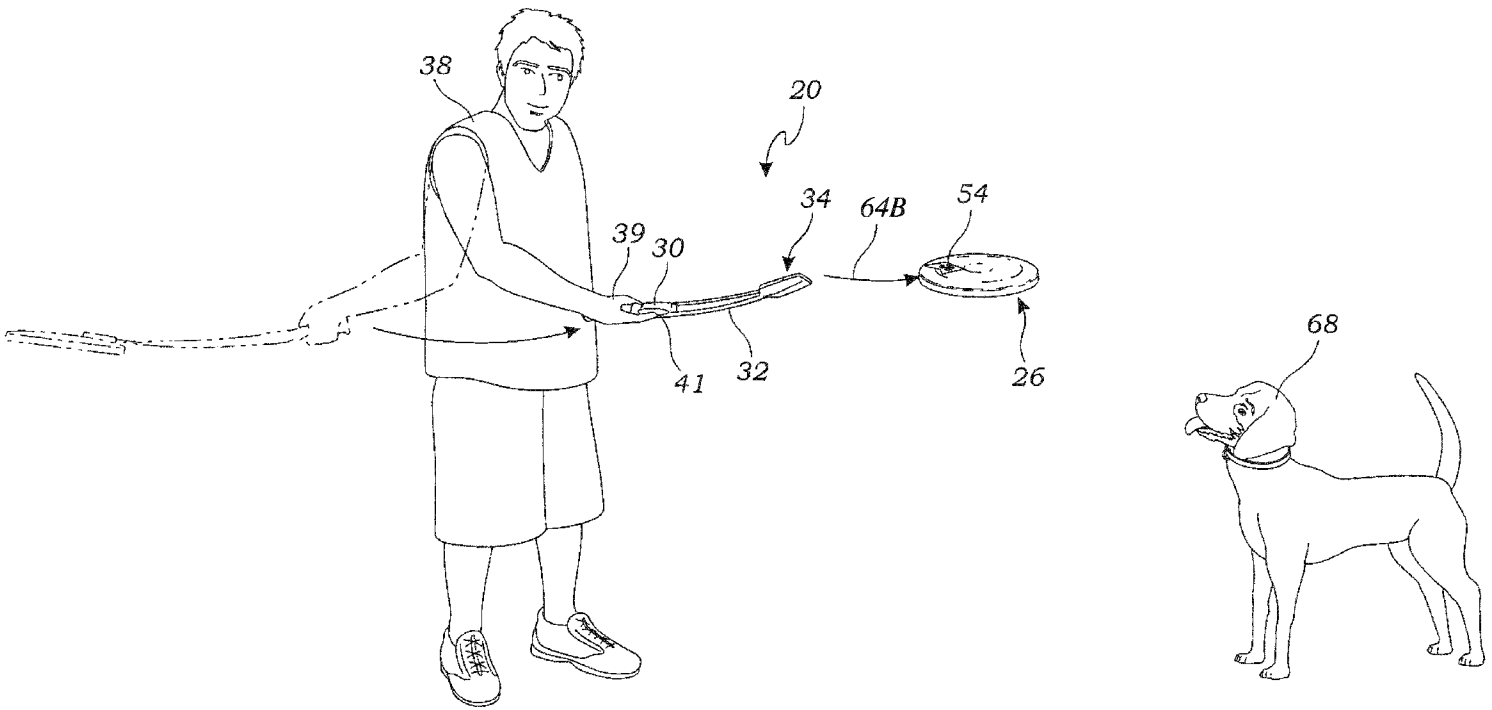
FIG. 11 is a perspective view of the user throwing the flying disc of FIG. 8 using the exemplary throwing apparatus of FIG. 1.

Because the engagement portion such as engagement portion 34 of a throwing apparatus such as throwing apparatus 20 functions to prevent rotation of an object about the engagement portion 34 when the object is engaged therewith, the user 38 is able to selectively orient the object using the throwing apparatus such as throwing apparatus 20. The user may then throw the object in that desired orientation mimicking the desired orientation by which the user 38 would traditionally throw the object by hand 39. This can be extremely beneficial when throwing an object that has a relatively more desirable orientation. For example, when throwing a substantially elliptically shaped object, such as the football shaped object 28, it is desirable to orient an end 62 (FIG. 9) to point in the direction 64 (FIG. 10) of the throw. Additionally, when throwing a relatively planar object, such as the flying disc 26, it is desirable to orient a circumferential edge 66 of the flying disc 26 (FIG. 8) to point in the direction 64B of the throw, as shown in FIG. 11. Not only does the engagement portion such as engagement portion 34 allow the object to be selectively oriented, but it may also allow the user 38 to selectively put a desired amount of spin on the object as it is thrown, depending on the position of the engagement aperture 42. For example, the football shaped object 28 of FIG. 9 may be thrown and spun about a relatively horizontal axis 63 in a similar fashion as the user 38 would traditionally throw a football with their hand 39, causing the football to spiral. Similarly, the flying disc 26 of FIGS. 8 and 11 may be thrown and spun about a relatively vertical axis 67, causing the flying disc 26 to rotate accordingly.

The capability of a throwing apparatus, such as throwing apparatus 20, to allow the user to substantially mimic traditionally grasping, orienting and throwing a wide range of objects by hand 39 is furthered in the exemplary embodiment, where the engagement portion like engagement portion 34 is substantially wedge-shaped with a pair of opposing, substantially planar engagement surfaces 44A and 44 B. Such a shape roughly mimics the shape of the open human hand 39. This, again, enables the user 38 to throw the object accurately and with relative ease; all without having to directly handle the object being thrown.

As mentioned above, in the exemplary embodiment, the shank 32 is slightly curved 31. The curve not only assists in the throwing of an object, but also assists in selectively engaging and orienting the object, depending on the type of object being used and the positioning of the engagement aperture like engagement aperture 42. More specifically, the curved shank 32 is configured for allowing the throwing apparatus 20 to be selectively used in at least one of a downwardly curved orientation, as illustrated in FIG. 10, or in an upwardly curved orientation, as illustrated in FIG. 11. Thus, where the engagement aperture like engagement aperture 42 of the object like ball 24 may be oriented substantially perpendicular with the ground when not engaged with the engagement portion 34, or where the object is to be thrown in a substantially overhand fashion, as illustrated in FIG. 10 with the ball 24, the user 38 is able to more easily engage, orient, and throw the object with the throwing apparatus 20 oriented in the downwardly curved orientation. Alternatively, where the engagement aperture like engagement aperture 42A of the object like flying disc 26 tends to be oriented substantially parallel with the ground when not engaged with the engagement portion like engagement portion 34, or where the object is to be thrown in a substantially underhand or sidearm fashion, as illustrated in FIG. 11 with the flying disc 26, the user 38 is able to more easily engage, orient, and throw the object with the throwing apparatus 20 in the upwardly curved orientation. It should be noted that the throwing apparatus 20 may be used in any number of orientations in addition to the downwardly curved and upwardly curved orientations shown in FIGS. 10 and 11, respectively, depending on the object and positioning of the engagement aperture like engagement apertures 42, 42A and 42B. Thus, the curved shank 32 of the exemplary embodiment assists in selectively engaging, orienting, and throwing a wide range of objects by allowing the user to grasp and use the throwing apparatus 20 in a wide range of orientations.

The present invention may be used in a wide range of various recreational activities that involve the throwing of objects, regardless of whether those activities involve two or more people, or even animals, such as a dog 68. In use, as shown in FIGS. 10 and 11, the user 38 grasps the handle portion 30 of the throwing apparatus like throwing apparatus 20, 20A, 20B and 20C and then inserts the substantially wedge-shaped engagement portion like one of the engagement portions 34, 34A, 34B and 34C into an engagement aperture like one of the engagement apertures 42, 42A and 42B. Again, the engagement aperture like one of the engagement apertures 42, 42A and 42B is configured for preventing the object from rotating about the engagement portion like one of the engagement portions 34, 34A, 34B and 34C when engaged therewith, allowing the object to be thrown in a desired orientation. With the object oriented in the desired orientation, the user 38 then swings the throwing apparatus like throwing apparatus 20, 20A, 20B and 20 C in a desired direction 64 and 64B, causing the object to disengage and travel in the desired direction 64 and 64B. Thus, the user 38 is never required to directly handle the object.

To summarize, regarding the exemplary embodiments of the present invention as shown and described herein, it will be appreciated that a recreational throwing apparatus is disclosed and configured for allowing a user to throw various types of objects without having to directly handle the objects. Because the principles of the invention may be practiced in a number of configurations beyond those shown and described, it is to be understood that the invention is not in any way limited by the exemplary embodiments, but is generally directed to a recreational throwing apparatus and is able to take numerous forms to do so without departing from the spirit and scope of the invention. Furthermore, the various features of each of the above-described embodiments may be combined in any logical manner and are intended to be included within the scope of the present invention.

While aspects of the invention have been described with reference to at least one exemplary embodiment, it is to be clearly understood by those skilled in the art that the invention is not limited thereto. Rather, the scope of the invention is to be interpreted only in conjunction with the appended claims and it is made clear, here, that the inventor(s) believe that the claimed subject matter is the invention.

What is claimed is:

1. A throwing apparatus for throwing an object having a receiving aperture mechanically associated therewith for removably associating said throwing apparatus with said receiving aperture, said throwing apparatus comprising:

a shank having a first end and a second end spaced from said first end, said shank having a length extending between said first end and said second end, and said shank having a shank axis, said shank being operable from a ready position to a throw position, a handle sized and shaped for grasping and by a user, said handle being attached to said first end of said shank, and said handle having a handle axis oriented at an acute angle from said shank axis; and an engagement structure attached to said second end of said shank and sized and shaped for removable insertion into and out of said receiving aperture of said object and operable between an engaged position in which said engagement structure is frictionally engageable in said receiving aperture and a disengaged position in which said engagement structure is separable from said receiving aperture of said object upon movement of said shank from said ready position to said throw position, said engagement structure being unitarily formed with said shank;

wherein said engagement structure is essentially rectilinear in projection with a first surface and a second surface both of which are opposite and spaced apart and wherein each of said first surface and said second surface have a length and a width which are essentially the same.

2. The throwing apparatus of claim 1, wherein the length of said first surface is greater than said width, wherein said first surface has a ridge extending upwardly therefrom substantially along the length of said first surface, and wherein said engagement structure with said ridge are sized to frictionally engage the receiving t structure aperture.

3. The throwing apparatus of claim 2, wherein said engagement structure is tapered with a proximal thickness greater than a distal thickness and proximal width greater than a distal width.

4. The throwing apparatus of claim 3, wherein the handle portion is formed to have at least one finger guide positioned and configured to receive a finger of the user's hand when the user is grasping said handle.

5. The throwing apparatus of claim 1, wherein the engagement structure has a distal end and a proximal end, and wherein said engagement structure has a first outside edge extending between said first surface and said second surface and a second outside edge spaced from said first outside edge and extending between said first surface and said second surface, and wherein said first outside edge and said second outside edge taper from said proximal end toward said distal end.

6. The throwing apparatus of claim 1, wherein said first surface is spaced from said second surface, wherein said first surface and said second surface extend from said proximal end to said distal end, and wherein said first surface and said second surface are spaced from each other a first thickness at said proximal end, and wherein said first surface and said second surface are spaced from each other a second thickness proximate said distal end, and wherein said first thickness is larger than said second thickness.

7. The throwing apparatus of claim 1, wherein the engagement structure is coated with a material that frictionally engages in said receiving aperture.

8. The recreational throwing apparatus of claim 1, wherein the engagement structure includes a stopper positioned and configured to engage the receiving structure upon insertion of said engagement structure into said receiving structure.

9. A throwing system comprising:

an object to be thrown by a user, said object having receiving aperture having a length, a width, and a height;

a throwing apparatus having:

a shank having a first end and a second end spaced from said first end, said shank being axially curved and having a length extending between said first end and said second end, a handle sized and shaped for grasping by a user, said handle being attached to said first end of said shank;

engagement structure attached to said second end of said shank, said engagement structure having a first surface which is substantially planar and a second surface which is substantially planar and spaced from said first surface to form a wedge having a height, a width and a length selected for removable engagement of said engagement structure with said receiving aperture; wherein said engagement structure is essentially rectilinear in projection with a first surface and a second surface both of which are opposite and spaced apart and wherein each of said first surface and said second surface have a length and a width which are essentially the same.

10. A throwing system comprising:

an object configured for throwing by a user, said object having a receiving aperture mechanically associated therewith;

throwing apparatus for throwing said object, said throwing apparatus comprising:

a shank having a first end and a second end spaced from said first end, said shank having a length extending there inbetween, and said shank being arcuate, a handle for grasping by a user, said handle being attached to said first end, and an engagement structure attached to said second end of said shank, said engagement structure being sized for removable insertion into and out of said receiving aperture of said object and operable between an engaged position wherein said engagement structure is positionable in and frictionally engageable in said receiving aperture and a disengaged position in which said engagement structure is separable from said receiving aperture; wherein said engagement structure is essentially rectilinear in projection with a first surface and a second surface both of which are opposite and spaced apart and wherein each of said first surface and said second surface have a length and a width which are essentially the same.

11. The throwing system of claim 10, wherein said engagement structure has at least one flat surface having a width and a length larger than said width with a ridge formed to extend outwardly from said at least one flat surface and wherein said engagement structure is shaped to snuggly and removably fit into said receiving aperture.

12. The throwing system of claim 10, wherein said object has a body having a mass and a shape selected for throwing.

13. The throwing system of claim 12, wherein the object is a ball and wherein said receiving aperture is a slot formed in said ball.

14. The throwing system of claim 12, wherein the object is a disc and wherein said receiving aperture includes a pocket forming member attached to said disc to form a pocket sized and shaped to removably receive said engagement structure.

15. The recreational apparatus of claim 14, wherein said disc has at least one surface that is circular in projection with a central axis; and wherein said receiving aperture is attached to said surface offset from said central axis.

16. The recreational apparatus of claim 15, wherein said pocket is sized to removably receive said engagement member, and wherein said engagement member has opposite substantially planar surfaces.

17. A method for selectively engaging and throwing an object, the method comprising:

providing an object configured for throwing by a user, said object having a receiving aperture mechanically associated therewith, said object being positionable on a support surface;

providing throwing apparatus for throwing said object, said throwing apparatus comprising:

a shank having a first end and a second end spaced from said first end, said shank having a length extending there inbetween, and said shank being axially arcuate, a handle for grasping by a user standing on said support surface, said handle being attached to said first end, and an engagement structure attached to said second end of said shank and sized for removable insertion into and out of said receiving aperture of said object, wherein said engagement structure is operable between an engaged position wherein said engagement structure is positionable in and frictionally engageable in said receiving aperture and a disengaged position in which said engagement structure is separable from said receiving aperture; wherein said engagement structure is essentially rectilinear in projection with a first surface and a second surface both of which are opposite and spaced apart and wherein each of said first surface and said second surface have a length and a width which are essentially the same grasping said handle of said throwing apparatus;

manipulating said handle and in turn said shank to urge said engagement structure into said receiving aperture of the object;

manipulating said handle to cause said engagement structure to be elevated and to in turn cause said object on said engagement structure to be removed from said support structure; and swinging the throwing apparatus in a desired direction at a speed to cause the object to disengage from said engagement structure and travel in the desired direction.

18. The throwing apparatus of claim 1, wherein the first surface and second surface are both substantially planar, and wherein the receiving aperture is formed in the object and is a substantially elliptically-shaped opening sized to snuggly receive the engagement structure therein.

19. The throwing apparatus of claim 1 wherein the engagement structure has structure proximate its proximal end to inhibit the insertion of said engagement member into said receiving structure.

20. The throwing apparatus of claim 3, wherein the shank, the handle, said shank and the engagement structure are unitarily formed and all made of plastic.

* * * * *

UNITED STATES PATENT AND TRADEMARK OFFICE

CERTIFICATE OF CORRECTION

PATENT NO. : 8,973,564 B1
APPLICATION NO. : 12/860703
DATED : March 10, 2015
INVENTOR(S) : Saber et al.

It is certified that error appears in the above-identified patent and that said Letters Patent is hereby corrected as shown below:

Title Page, item (75) Inventors: "Michael Saber" should be --Michael A. Saber--

"Joseph Buescher" should be --Joseph A. Buescher--

Title Page, item (56) Add: --2,521,703 09/1950 Emmitt--

--D232,236 07/1974 La Borde et al. D23/01--

--D530,116 10/2006 Schmitt D6/470--

Signed and Sealed this
Twenty-sixth Day of January, 2016

Michelle K. Lee

Michelle K. Lee
*Director of the United States Patent and Trademark Office*